United States Patent [19]

Voirin et al.

[11] Patent Number: 4,492,178

[45] Date of Patent: Jan. 8, 1985

[54] APPARATUS FOR APPLYING SOLID DEVELOPER PARTICLES TO THE RECORDING ELEMENT OF A NON-IMPACT PRINTER

[75] Inventors: Jean-Philippe Voirin, Hericourt; Bernard Cherbuy, Belfort, both of France

[73] Assignee: Cii Honeywell Bull (Societe Anonyme), Paris, France

[21] Appl. No.: 505,973

[22] Filed: Jun. 20, 1983

[30] Foreign Application Priority Data

Jul. 8, 1982 [FR] France ..... 82 12020

[51] Int. Cl.[3] ..... B05C 11/02

[52] U.S. Cl. ..... 118/653; 118/657

[58] Field of Search ..... 118/657, 653

[56] References Cited

U.S. PATENT DOCUMENTS 4,185,130 1/1980 Edwards et al. ..... 427/47

*Primary Examiner*—Bernard D. Pianalto

*Attorney, Agent, or Firm*—Kerkam, Stowell, Kondracki & Clarke

[57] ABSTRACT

The invention relates to magnetic printers and, more particularly, to an apparatus for applying solid developer particles to the recording drum of a non-impact printer. This apparatus comprises, on the one hand, a conveyor roller (22) which brings the developer particles from a particle storage or supply tank (15) to the vicinity of the recording drum (10) and, on the other hand, a baffle plate or deflector (23) positioned between the roller (22) and the drum (10). The roller (22) is coated with magnetized strips having on their outer surfaces magnetic helicoidal lines such that on two adjacent strips the pitch of the magnetic lines of one strip is opposed to that of the other strip.

16 Claims, 6 Drawing Figures

APPARATUS FOR APPLYING SOLID DEVELOPER PARTICLES TO THE RECORDING ELEMENT OF A NON-IMPACT PRINTER

BACKGROUND OF THE INVENTION

1. Field of the Invention

The present invention relates to an apparatus for applying solid developer particles to the recording element of a non-impact printer.

2. Description of the Prior Art

In present-day data processing equipment, fast printers are finding increasing application, in which the printing of the characters is effected without requiring raised type impacting on a recipient sheet of paper. These printers, called non-impact or strikeless transfer printers, ordinarily comprise a recording element which usually consists of a rotary drum or an endless belt, on the surface of which sensitized areas can be formed by electrostatic or magnetic means. These sensitized areas are also called latent images and correspond to the characters or images to be printed. These images are then developed, that is to say, made visible, with the aid of a powdery developer deposited on the recording element, and which is only attracted by the sensitized areas thereof. Thereupon, this recording element is brought into contact with a sheet of paper so as to permit the developer particles that have been deposited on these areas to be transferred onto this sheet in order to be fixed definitively thereon.

To apply this powdery developer to the recording element of a printer of this type, various applicator means have been used. For example, a device has been employed which comprises a housing containing the powdery developer, said housing having an opening past which moves the recording element. The inking of the recording element is effected by means of a cylindrical brush which, turning within the housing, projects the developer particles onto the surface of the element moving past said opening. This device has not given complete satisfaction due to the fact that it causes the formation of a cloud of developer particles which spreads on the outer surface of the case. Such clouds are particularly disagreeable for persons who are near the printer and who are attached by this cloud. Another problem with such devices is that they cause an undesirable electrification of the particles which, projected onto the recording element, can continue to exist on the areas that have not been sensitized by the recording element as a result of electrostatic attraction.

If the developer is capable of being attracted magnetically, a magnetic roller of the type as described and shown in French patent 1,566,007 and comprising a set of elongated magnetic elements, one arranged beside the other about a shaft parallel thereto, can be utilized to apply this developer. Each of these magnetic elements is magnetized radially so as to exhibit a constant magnetic polarity throughout the length thereof. The magnetic polarities exhibited by two adjacent magnetic elements have opposite signs. This magnetic roller, which has given good results when used in an apparatus for developing latent images with electrostatic charge for transporting a powdery developer which is capable of being attracted magnetically, has not been completely satisfactory when used as a roller for conveying a powdery developer in an apparatus for developing magnetic latent images such as, for example, a magnetic printer. Indeed, due to the fact that this magnetic roller is placed in the immediate vicinity of the element for recording latent images, this recording element is necessarily subject to the action of the magnetic fluxes generated by the magnetic elements of this roller. As a result, the information recorded on this recording element runs the risk of being substantially altered at the moment when it moves past this roller for applying the developer.

This latter drawback can be overcome by inserting between the applicator roller and the recording element a deflector intended to collect the developer particles conveyed by the roller. The deflector has one of its edges arranged in the immediate vicinity of the recording element so as to form therewith a trough having substantially the shape of a dihedral, in which the developer particles collected by the deflector will be gathered. Thus, an applicator means is obtained of the type described and shown in French patent No. 2,408,462 and in which the recording element is moved in a direction such that the collected particles in the trough are carried to the angle of the dihedral. The particles carried beyond said angle remain applied only to the sensitized areas of the recording element. However, it has been noted that if the applicator means contains a conveyor roller of the type as described in the aforementioned French patent No. 1,566,007, the developer particles would be aligned along the external magnetic lines of force which, on the surface of the conveyor roller, extend from each one of the magnetic elements with a magnetic north polarity to each one of the neighboring magnetic elements with a magnetic south polarity. Since these external field lines form arches which are oriented perpendicularly to the roller's axis of rotation, the developer particles, placed along these field lines, form chains of particles which are arranged perpendicularly to said axis. Under these circumstances, when these particle chains are stopped during passage by the baffle plate, they break up, but continue to form within the trough, fragments of chains having an orientation which is substantially perpendicular to the surface of the recording element. The result is that these particles, when they are applied to the sensitized areas of this element, have the tendency to enter into combination with one another so as to form thread-like aggregates of particles resulting in the appearance of trains of particles on the surface of the recording element and, thus, in trains that are particularly disagreeable to behold for the characters formed during the transfer of these particles to the paper.

SUMMARY OF THE INVENTION

The present invention overcomes this disadvantage and proposes a device which enables developer particles to be applied to the recording element of a non-impact printer without causing either an alteration of the information recorded on this element, or trains of particles on the surface of this element.

More particularly, the present invention relates to a device for applying to the recording element of a non-impact printer solid developer particles contained in a tank. Said device comprises, on the one hand, a conveyor roller arranged such as to bring these particles near the surface of this element and, on the other hand, a deflector inserted between this element and the conveyor roller to collect the particles conveyed by this roller. Said deflector has one of its edges arranged in the immediate vicinity of said element in order to form therewith a trough having substantially the shape of a dihedral and in which are gathered the particles thus collected. The recording element is moved in a direction so as to carry these particles to the angle of said dihedral, the particles that are carried beyond said angle remaining only applied to the sensitized areas of said recording element. The invention is characterized in that, since the developer is capable of being attracted magnetically, the conveyor roller is formed of a rotary cylinder which is coated on its outer cylindrical surface with strips of magnetic material arranged in side by side relation parallel to the rotational axis of said cylinder. Each one of said strips is magnetized such as to have on the outer surface thereof magnetic poles which form equidistant magnetic lines whose magnetic north or south polarity alternates from one magnetic line to the other. The magnetic lines extend in the direction of portions of helices with a constant pitch, the helices being so arranged that on two adjacent strips the pitch of the helix portions of one of these two strips is the reverse of that of the helix portions of the other strip.

BRIEF DESCRIPTION OF THE DRAWINGS

The nature of the present invention and the various features, details and advantages thereof will be better understood from the ensuing description given by way of non-limitative example and taken in connection with the accompanying drawings, in which.

DESCRIPTION OF THE PREFERRED EMBODIMENTS

Figure 1:
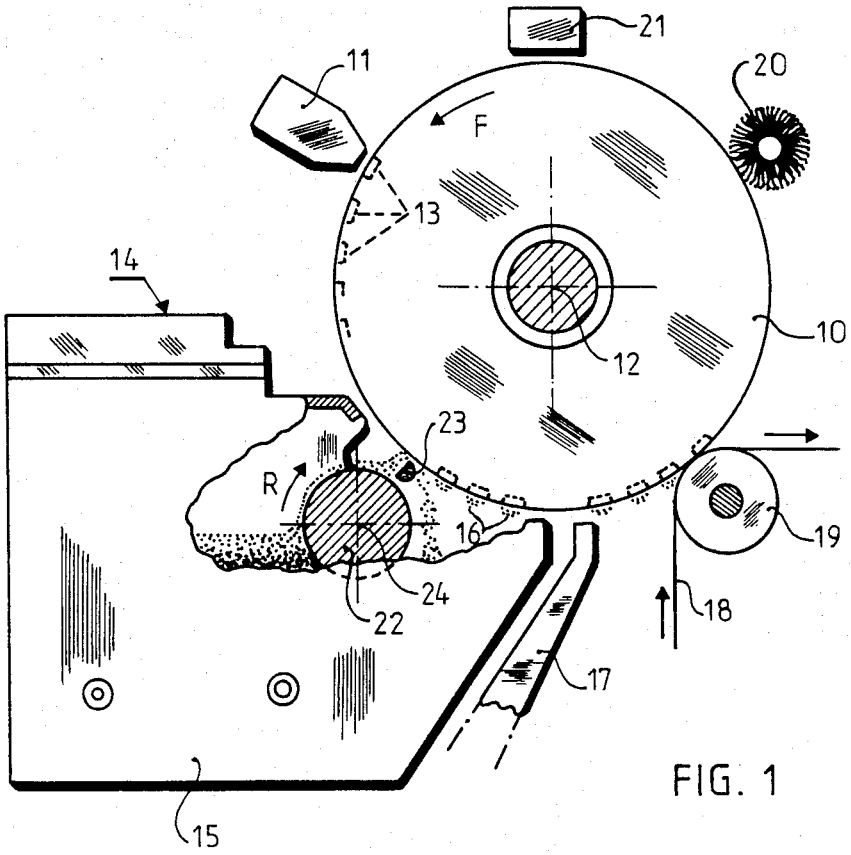
FIG. 1 is a partial schematic view of a magnetic printer equipped with a developer-applicating device constructed according to the present invention.

The printer, one part of which is shown schematically in FIG. 1, comprises a recording element which, in the example described herein, consists of a magnetic drum 10. The magnetic drum 10 is rotated in the direction of arrow F by an electric motor (not shown). The recording of the information on this drum is effected by a magnetic recording element 11 which is located near the drum's outer surface. In the example described, this recording element 11 is composed of a group of devices including several magnetic recording heads which, arranged side by side, are brought into line parallel to the rotational axis 12 of drum 10. Each of these recording heads generates, when it is energized repeatedly by an electric current, a variable magnetic field, which results in the creation of magnetic domains or "magnetic points" on the surface of the drum which moves past the recording element 11. The instants of excitation of these heads are determined in known fashion so as to obtain on the drum's surface groups of magnetic domains 13, called magnetized areas or magnetic latent images, whose shapes correspond to those of the characters to be printed. These magnetized areas 13 then move past the window of an applicator means 14 which is located below drum 10 and which enables particles of a powdery developer contained in a tank 15 to be applied to the drum's surface. The developer particles, which are thus applied to drum 10, adhere in principle only to the magnetized areas thereof, so that the magnetized areas which have moved past the applicator means 14 appear coated with a developer layer which forms on drum 10 the image of the characters to be printed.

It should be mentioned here that this developer consists of magnetic particles which are coated with a thermoplastic resin which, through heating, is capable of melting and of being fixed on a sheet of paper on which it has been deposited. By way of example, the developer contained in tank 15 may be that which has been described in the patent application filed in France by the applicant on Mar. 20, 1980 and published under No. 2,478,839. As indicated hereinabove, this developer, which is applied to drum 10, adheres mainly to the magnetized areas 13, thus forming deposits 16 of particles on the drum's surface. These deposits 16 are then carried past a retouching device 17 whose function is to eliminate the particles that have adhered to locations other than the magnetized areas 13, as well as the particles that are in excess on said areas. Whereupon almost all of the developer particles that continue to exist on drum 10 are transferred to a sheet of paper 18 which is applied to drum 10 by means of a pressure roller 19. The residual developer particles which, when this transfer takes place, are still on drum 10, are then dislodged by means of a cleaning device 20 known in the prior art, e.g., a brush. Thereupon, the magnetized areas which have moved past the cleaning device 20 move past an eraser 21 where they are erased. This allows the demagnetized portions of drum 10 to be remagnetized when they move past the recording element 11 as a result of continued rotation of the drum.

As can be seen from FIG. 1, the applicator means 14 comprises, on the one hand, a conveyor element 22 which takes away developer particles in tank 5 in order to bring them near the surface of drum 10 and, on the other hand, a stationary baffle plate or deflector 23 positioned between conveyor element 22 and drum 10 in order to cause the particles conveyed by element 22 to be collected and applied to the surface of drum 10. An applicator means 14 of this type has especially been described and shown in French patent No. 2,408,462.

Figure 2:
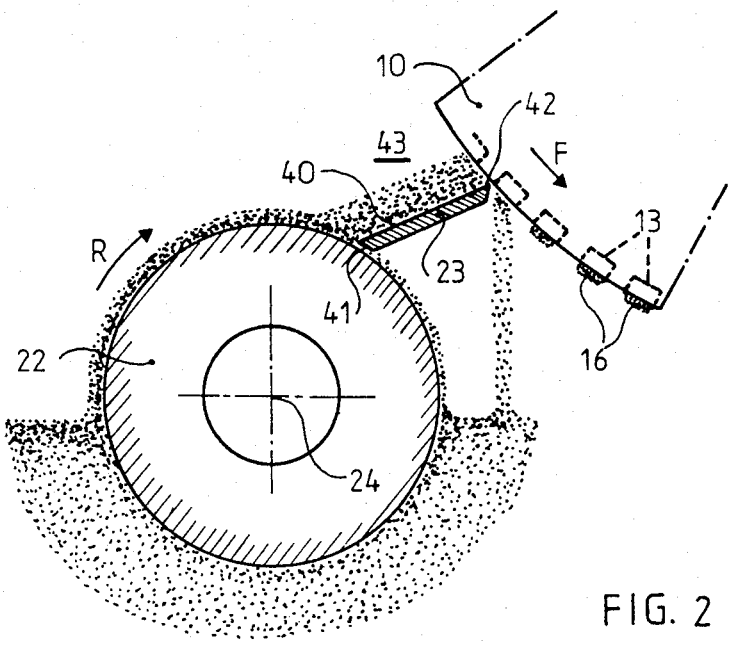
FIG. 2 is a scaled-up schematic view showing certain details of the embodiment of the applicator means of FIG. 1.

The conveyor element 22 of such an applicator means 14 is ordinarily composed of a magnetic roller 22 having a rotational axis 24 parallel to the rotational axis 12 of drum 10. The baffle plate or deflector 23 associated with magnetic roller 22 is a component which is affixed to the two side surfaces of tank 15, and has, as can be seen in FIG. 2, a plane surface 40 delimited by a first and a second edge 41 and 42, respectively, parallel to axes 12 and 24. The second edge 42 preferably forms a sharp corner so as to avoid an accumulation of particles on said edge. The baffle plate or deflector 23, whose first edge 41 is practically in contact with magnetic roller 22, is located in such a way that its second edge 42 is in the immediate vicinity of the surface of drum 10 and that its face 40 forms with the plane delimited by axis 12 of the drum and the axis 24 of the magnetic roller a dihedral whose angle is less than 45 degrees.

Magnetic roller 22 is rotated in the direction indicated by arrow R in FIGS. 1 and 2 by means of an electric motor (not shown). This direction is such that the developer particles conveyed by magnetic roller 22 are carried to face 40 of baffle plate or detector 23 and are stopped or removed from the roller during passage of the roller surface past edge 41 of the baggle plate, at least the majority thereof. The particles which are thus removed then collect in a trough 43 delimited by the surface of drum 10 and face 40 of baffle plate 23. The direction of rotation of drum 10, indicated by arrow F, is chosen such that the particles collected in trough 43 are carried to the edge or corner 42 of baffle plate 23 so that some of the particles can be applied to the magnetized areas 13 of drum 10. The particles applied to areas 13 and thus carried by drum 10 as it continues its rotation are not stopped by baffle plate 23 because of the fact that the baffle plate is spaced slightly away from the drum so that it does not touch the drum. The space or opening between sharp corner 42 and drum 10 is of a width sufficient to enable the developer particles carried by the drum to leave the trough 43. The developer particles applied to the magnetized areas of the drum exit from trough 43 and continue to adhere to these areas and thus make visible the characters to be printed. Those particles that leave trough 43 without being retained by the drum usually fall back into tank 15.

Figure 3:
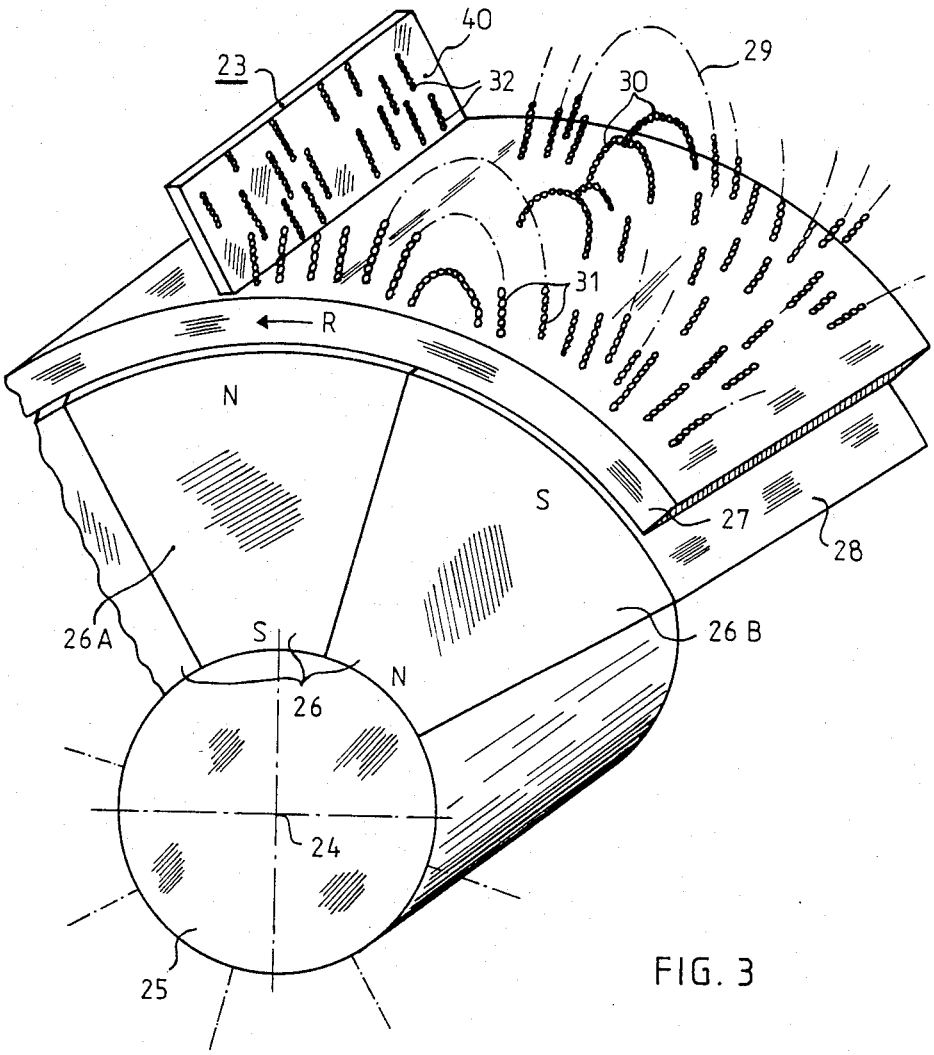
FIG. 3 is a perspective view, with some parts broken away, of a magnetic roller as is known from the prior art for applying a developer to the recording element of a magnetic printer, said view showing the manner in which the developer particles orient to the roller surface.

The magnetic roller which has been shown with certain parts broken away in FIG. 3 is known from the prior art and has been described in French patent No. 1,566,007. It will be recalled that this roller comprises a stationary shaft 25 made of a material with great magnetic permeability such as, for example, soft iron. Magnetic elements 26 are placed side by side around shaft 15 parallel thereto so as to form a ring around this shaft. To simplify the drawing, only two magnetic elements 26A and 26B are depicted in FIG. 3, but it should be pointed out that the number of these elements is well above two. This number has been chosen so that it can be a multiple of two. Thus, for example, in the example shown in FIG. 3, the roller comprises eight magnetic elements.

The roller of FIG. 3 also has a cylindrical sleeve 27 laced around the ring formed by the magnetic elements and mounted such as to turn about shaft 25 in the direction indicated by arrow R in FIG. 3. This sleeve is made of non-magnetic material such as, for example, aluminum.

As can be seen in FIG. 3, the magnetic elements 26 are magnetized radially, that is to say, in a direction perpendicular to axis 24 so that each magnetic element has on its face 28 situated opposite sleeve 27 a magnetic polarity of opposite sign when one goes from one magnetic element to the next magnetic element. Thus, for example, if magnetic element 26A in FIG. 3 has on its face situated opposite sleeve 27 a magnetic north polarity (N), magnetic element 26B adjacent to element 26A has on its face 28 situated opposite sleeve 27 a magnetic south polarity (S). Under these circumstances, the external field lines of the magnetic field generated by magnetic elements 26 extend from faces 28 with magnetic north polarity to faces 28 with a magnetic south polarity.

In FIG. 3, only some of these external field lines 29 are indicated by a dash-dotted line to simplify the drawing. If the magnetic roller described above is brought into contact with a powdery developer which is capable of being attracted magnetically, the outer surface of sleeve 27, as it rotates, will be covered with a layer of developer particles. During this operation, some of the developer particles will adhere directly to the surface of sleeve 27, while others will be placed outside said surface along external field lines 28 so as to form particle chains, some of which (30) in FIG. 3 are curved in the form on an arch, while others (31) are curved in the form of a partial arch oriented substantially perpendicularly to the surface of the sleeve. Thus, as can be seen in FIG. 3, all the particle chains are contained in planes which are perpendicular to rotational axis 24 of the roller. The result is that the developer particles that have been deposited on this sleeve are stopped by baffle plate 23 and continue to form chains or fragments of chains 32 which will pile up on face 40 of baffle plate 23, one remaining substantially parallel to the other, as can be seen in FIG. 3. These particles, which thus enter into combination with one another, form, when they are subsequently applied to the surface of drum 10, thread-like aggregates of particles which not only cover the magnetized zones of this drum, but spill over even beyond these areas so that, when these aggregates are then transferred onto the paper 18, they form trains of particles which greatly impair the quality of the print.

The magnetic roller of the present invention overcomes this drawback. In the embodiment shown in FIG. 4, magnetic roller 22 takes the shape of a cylinder 50 having a shaft 51 which enables it to swivel in bearings (not shown) mounted on the side faces of tank 5. The bearings are so arranged that the rotational axis 24 of roller 22 is parallel to the rotational axis 12 of drum 10. Cylinder 50 is made of non-magnetic material such as, for example, copper, glass, or even a plastic material. In the example described herein, it is assumed that cylinder 50 is made of aluminum.

Figure 5:
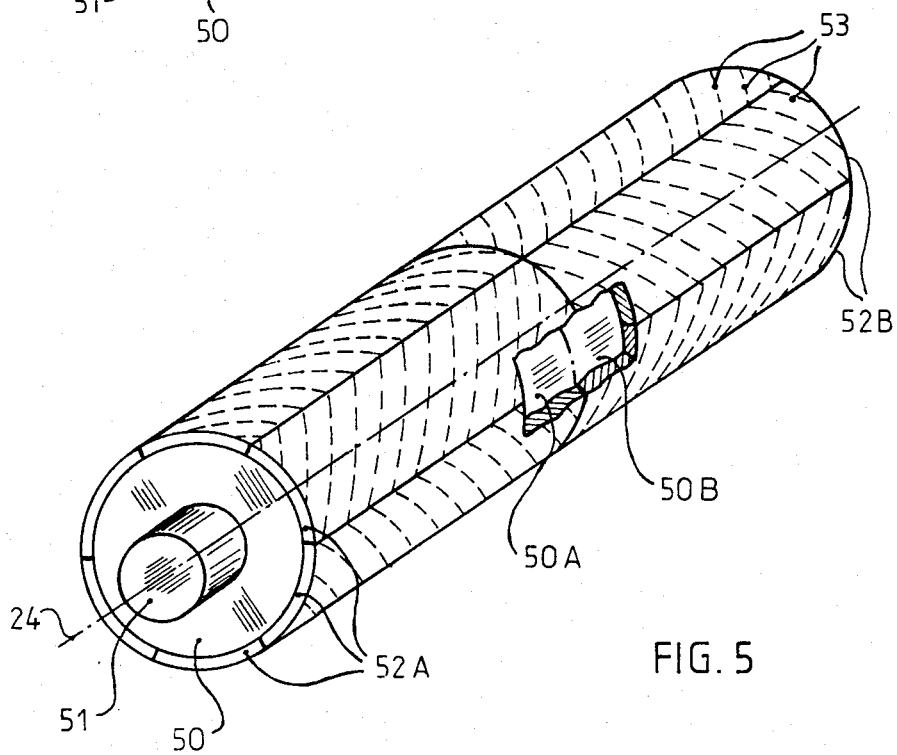
FIG. 5 shows a second embodiment of a magnetic roller forming part of the applicator means which equips the printer shown in FIG. 1.

FIG. 5 shows that the outer surface of cylinder 50 is coated with strips 52 of magnetic material, the strips are positioned adjacent to one another and parallel with the rotational axis 24 of cylinder 50.

Figure 4:
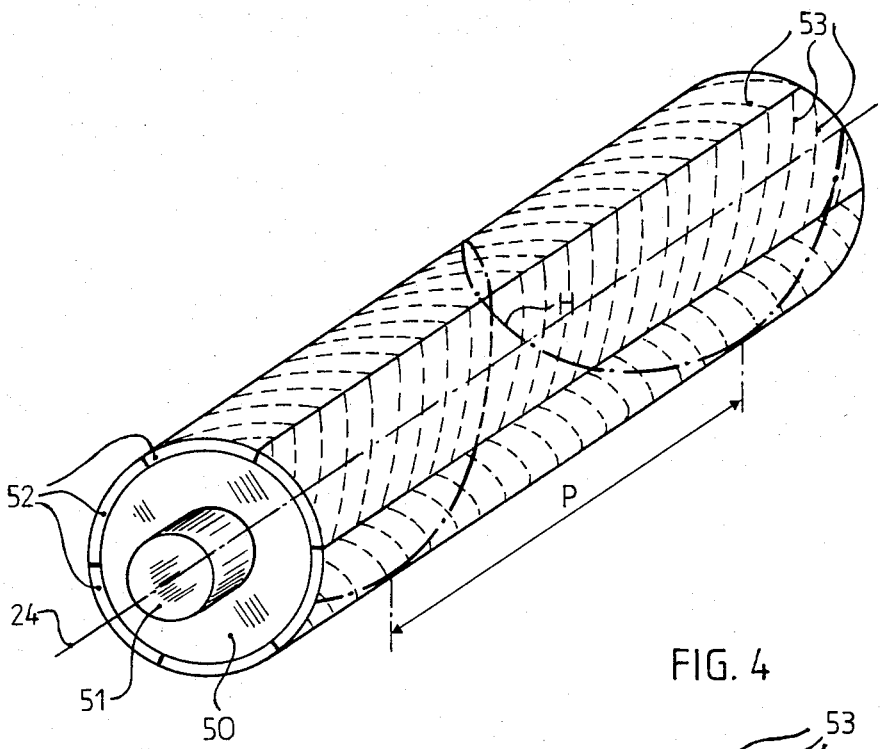
FIG. 4 shows a first embodiment of a magnetic roller forming part of the application means which equips the printer shown in FIG. 1.

In the example of FIG. 4, six strips 52 are thus arranged on cylinder 50, with each strip extending throughout the length of the cylinder. The flexible magnetic material of which these strips are made is well known in the art and usually consists of an elastomer into which magnetic particles have been incorporated. Thus, this flexible magnetic material can be of the type mass-produced by Produits Chimiques Ugine-Kuhlmann under the trade name of "Ferriflex" (registered mark).

Figure 6:
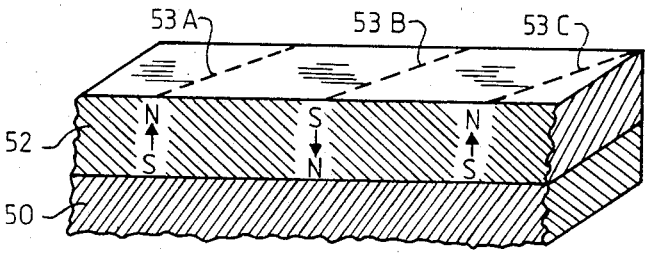
FIG. 6 is a perspective view, partially in section, according to a plane which is perpendicular to the rotational axis of a part of the roller shown in FIG. 4.

As can be seen in FIG. 6, which shows in section, according to a plane that extends through rotational axis 24, a portion of the magnetic roller of FIG. 5, each of strips 52 is magnetized permanently in a direction perpendicular to its thickness so as to have on its outer surface magnetic poles that form magnetic lines such as 53A, 53B, 53C which are equidistant from one another. The magnetic north or south polarity of said lines alternate from one magnetic line to the other. Thus, for example, magnetic lines 53A and 53C shown in FIG. 6 have a magnetic north polarity (N), while magnetic line 53B has a magnetic south polarity (S).

In FIGS. 4, 5 and 6, these magnetic lines have been shown symbolically by broken lines and are generally denoted by the reference numeral 53 in FIGS. 4 and 5. The equidistance of these magnetic lines depends on the thickness of strip 52. It is pointed out, by way of example, that if the strip is 1 mm thick, these magnetic lines 55B are separated from one another by a distance of 2.54 mm, and that if the strip is 2 mm thick, these magnetic lines are separated from each other by a distance of 5.08 mm.

FIG. 5 shows that these magnetic lines 53 are oriented to the surface of the magnetic roller according to the helix portions with the same pitch, one of said helices (H) being indicated by a dash-dotted line in FIG. 4. In a particularly advantageous embodiment, pitch P of these helices is chosen such as to be numerically equal to the length D of a cross section of cylinder 5, D being the diameter of said cylinder. Under these circumstances, the angle at which magnetic lines 53 intersect the generators of the cylinder is equal to 45 degrees. It is also pointed out that, as can be seen in FIG. 4, the portions of the helices formed by the various magnetic lines 53 do not all have the same direction of winding. In other words, the pitch of these portions of helices is such that on two adjacent strips 52 the pitch of the portions of helices of one of these two strips is the reverse of that of the portions of helices of the other strip. The number of strips 52 placed on cylinder 5 is chosen such as to be even at all times, so that the characteristic which has just been mentioned concerning the pitch of the portions of helices can always be complied with.

It will be better understood that various embodiments of the magnetic roller of the invention can be contemplated. Thus, in the embodiment of FIG. 5, strips 52 of flexible material each have a length less than that of cylinder 50. In the special case depicted in FIG. 5, the length of each of the strips 52 is equal to half that of cylinder 5 so that, when two of these strips, which are oriented in such a way that their broad side is parallel to the rotational axis 24 of the cylinder, are placed end to end on this cylinder, touching each other with their narrow side, the two bands or touching strip extend throughout the length of the cylinder. Put differently, if cylinder 50 is assumed to be divided, perpendicularly to its rotational axis 24, into two portions 50A and 50B of equal length, each of these cylinder portions is covered with 2 n strips, 2 n being an even number. In FIG. 5, the strips covering the portion of cylinder 50A are denoted by 52A and those covering the portion of cylinder 50B by 52B. It can also be seen in FIG. 5 that the pitch of the portions of helices according to which magnetic lines 53 of strips 52A and 52B are oriented such that on two adjacent strips, the pitch of the portions of helices of one of these two strips is the reverse of that of the portions of helices of the other strip.

It should also be mentioned that in the more general case where cylinder 50 is assumed to be divided, perpendicularly to its rotational axis 24, into p equal portions and where the length of each of the strips 52 of magnetic material equals the length of each of these p cylinder portions, each of these p cylinder portions is covered with an even number (equal to 2 n) of strips 52. The 2 n strips covering each of the p cylinder portions are adjacent to one another and run parallel to the rotational axis of the cylinder. In addition, the 2 n strips of the same cylinder portion are, in turn, adjacent to the 2 n strips of the adjacent cylinder portion and are aligned therewith.

Strips 52 of magnetic material which cover cylinder 5 are not necessarily made of flexible material that incorporates magnetic particles. Thus, in one embodiment, these strips 52 can be made of a magnetic non-flexible material, for example, ferrite, molded such as to take the form of a hollow cylinder (or portions of a hollow cylinder, such as, for example, 52), whose inner diameter corresponds to the outer diameter of cylinder 50, said hollow cylinder being magnetized so as to have, on its outer face, magnetic poles that form magnetic lines which extend according to portions of a helix placed in the same way as that shown in FIGS. 4 and 5.

By using the magnetic roller described above in a device of the type described in French patent No. 2,408,452, it was indeed determined no developer particles were bundled into chains within the trough formed by the baffle plate and the recording element and that, as a result, the subsequent transfer of these particles onto the paper practically did not result in trains of particles, so that the print quality was greatly improved.

While particular embodiments of the invention have been shown and described, it will be understood that the invention is not limited to these embodiments which have been set forth for purposes of illustration only. On the contrary, it includes all the means that constitute technical equivalents to those shown and described herein, taken separately or jointly and carried into effect within the scope of the appended claims.

We claim:

1. In an apparatus for applying to the recording element (10) of a non-impact printer solid magnetically attractable developer particles contained in a tank (15), said apparatus comprising a conveyor roller (22) in the tank (15) arranged so as to bring said particles near the surface of said element (10), a baffle plate (23) positioned between said element and said conveyor roller to collect the particles conveyed by said roller, said baffle plate having a first edge (42) arranged in the immediate vicinity of said element (10) in order to form therewith a trough (43) having substantially the shape of a dihedral in which the particles thus gathered are collected, said element being movable in a direction (F) so as to cause its surface to pass the trough (43) and pick up particles from the trough, the particles carried beyond said trough remaining applied only to sensitized areas of said recording element, the improvement comprising a rotary cylinder (50), conveyor roller (22) coated on its outer cylindrical surface with strips (52) of magnetic material arranged side by side and parallel with the rotational axis (24) of said cylinder, each one of said strips being magnetized such as to have on the outer face thereof magnetic poles forming equidistant magnetic lines (53), the magnetic north (N) or south (S) polarity of which alternates from one magnetic line to the other, said magnetic lines extending in the direction of portions of helices with a constant pitch, said helices being so arranged that on two adjacent strips (52) the pitch of the helix portions of one of said two strips is the reverse of that of the helix portions of the other strip.

2. The applicator apparatus as defined in claim 1, wherein the magnetic lines (53) are oriented in such fashion as to intersect the generators of the cylinder (50) at a 45 degree angle.

3. The applicator apparatus as defined in claim 1, wherein each one of said strips (52) if of a flexible magnetic material and extends throughout the length of the rotary cylinder (50).

4. The applicator apparatus as defined in claim 1, wherein the rotary cylinder (5) is divided perpendicularly to its rotational axis (24) into p cylinder portions (such as 50A and 50B) having the same length, each of said strips (52) being of flexible magnetic material having a length equal to that of each one of said p cylinder portions and the number of said strips (52) being equal to 2 pn, so that each one of said p cylinder portions is covered with 2 n of said strips, all of said strips being adjacent to one another.

5. The applicator apparatus as defined in claim 3, wherein the rotary cylinder (5) has a 25-mm diameter and the number of strips (52) covering the same is 4.

6. The applicator apparatus as defined in claim 4, wherein the rotary cylinder (5) has a 25-mm diameter and the number of strips (52) covering each one of said cylinder portions is 4.

7. The applicator apparatus as defined in claim 1, wherein each one of said strips (52) is made of non-magnetic flexible material in the form of a hollow cylinder, the inner diameter of which corresponds to the outer diameter of the outer diameter of the rotary cylinder (50).

8. The applicator apparatus as defined in claim 2, wherein each one of said strips (52) is of a flexible magnetic material and extends throughout the length of the rotary cylinder (50).

9. The applicator apparatus as defined in claim 3, wherein the rotary cylinder (5) is divided perpendicularly to its rotational axis (24) into p cylinder portions (such as 50A and 50B) having the same length, each of said strips (52) being of flexible magnetic material having a length equal to that of each one of said p cylinder portions and the number of said strips (52) being equal to 2 pn, so that each one of said p cylinder portions is covered with 2n of said strips, all of said strips being adjacent to one another.

10. The applicator apparatus as defined in claim 3, wherein each one of said strips (52) is made of non-magnetic flexible material in the form of a hollow cylinder, the inner diameter of which corresponds to the outer diameter of the rotary cylinder (50).

11. The applicator apparatus as defined in claim 8, wherein the rotary cylinder (5) has a 25-mm diameter and the number of strips (52) covering the same is 4.

12. The applicator apparatus as defined in claim 9, wherein the rotary cylinder (50) has a 25-mm diameter and the number of strips (52) covering each one of said cylinder portions is 4.

13. An apparatus for applying magnetic particles to a recording element which moves part a first end of a baffle plate, the particles being disposed within a container adjacent to a second end of the plate, the apparatus comprising a cylinder rotatable about an axis thereof and adapted to be disposed within the container adjacent to said second end, and a plurality of axially extending strips of magnetic material disposed about the periphery of the cylinder, each strip being magnetized so as to form on an outer surface thereof a plurality of substantially parallel magnetic lines of alternating polarity, the magnetic lines extending at an angle with respect to said axis and in the direction of portions of helices of constant pitch, the strips being magnetized such that the pitch of the helices along which the magnetic lines of one strip extend is the reverse of the pitch of the helices along which the magnetic lines of an adjacent strip extend.

14. The apparatus of claim 13, wherein said strips extend the length of said cylinder and are disposed about the periphery in abutting side-by-side relationship so as to cover said periphery.

15. The apparatus of claim 13, wherein each axially extending strip is divided into a plurality of segments in end-to-end relationship with one another, and the segments are magnetized such that the pitches of the helices along which the lines in adjacent segments extend are reversed.

16. The apparatus of claim 13, wherein said strips comprise axially extending portions of a hollow cylinder of magnetic material having an inner diameter sized to receive said first-mentioned cylinder.

* * * * *